United States Patent [19]

Reinhold

[11] Patent Number: 4,573,186

[45] Date of Patent: Feb. 25, 1986

[54] FINE FOCUS X-RAY TUBE AND METHOD OF FORMING A MICROFOCUS OF THE ELECTRON EMISSION OF AN X-RAY TUBE HOT CATHODE

[75] Inventor: Alfred Reinhold, Wunstorf, Fed. Rep. of Germany

[73] Assignee: Feinfocus Rontgensysteme GmbH, Wunstorf, Fed. Rep. of Germany

[21] Appl. No.: 505,056

[22] Filed: Jun. 16, 1983

[30] Foreign Application Priority Data

Jun. 16, 1982 [DE] Fed. Rep. of Germany ..... 3222511

[51] Int. Cl.[4] ..... H01J 35/06; H01J 35/14

[52] U.S. Cl. ..... 378/138; 378/136

[58] Field of Search ..... 378/138, 43, 136

[56] References Cited

U.S. PATENT DOCUMENTS 2,866,113 12/1958 Cosslett ..... 378/138

4,159,436 6/1979 Ely ..... 378/138

*Primary Examiner*—Alfred E. Smith

*Assistant Examiner*—T. N. Grigsby

*Attorney, Agent, or Firm*—Robert E. Burns; Emmanuel J. Lobato; Bruce L. Adams

[57] ABSTRACT

In an X-ray tube having a glow cathode for emitting an electron beam, an anode, focusing and deflecting coils and a target in an evacuated envelope, the cathode is a U-bent filament the dimensions of which are large in relation to the electron emitting area. The cathode is heated by passing electric current through it and is differentially cooled so that a small surface area at the site of electron emission is at a substantially higher temperature than remaining surface areas of the cathode. Cooling is effected by a thick-walled cylindrical grid which surrounds the cathode and has at its outer end an annular inward projection which absorbs heat rays from the cathode. The grid has a funnel-shaped outer end surface having an included angle of about 100° to 140°. The electron emitting surface of the cathode lies approximately in a plane defined by the inner peripheral edge of the funnel-shaped end surface of the grid. The electric field applied to the cathode has its highest value at the small electron emitting surface of the cathode.

7 Claims, 6 Drawing Figures

FINE FOCUS X-RAY TUBE AND METHOD OF FORMING A MICROFOCUS OF THE ELECTRON EMISSION OF AN X-RAY TUBE HOT CATHODE

FIELD OF INVENTION

The invention relates to a fine focus X-ray tube in which a hot cathode surrounded by a grid, an anode in the form of a perforate diaphragm, electromagnetic concentrating and deflecting coils and a target are provided in an evacuated cylinder, and to a method of forming a microfocus of the electron emission of an x-ray tube hot cathode.

BACKGROUND OF THE INVENTION

In an effort to increase the resolving power of X-ray apparatus in order to detect ever smaller details in X-ray photographs, for example extremely fine hairline cracks in turbine blades, there have been developed X-ray tubes of which the hot cathode is produced from ever finer wire and is formed as a needle point in order that the electron emitting surface—on the needle point—is made as small as possible. It was heretofore believed that only in this manner, corresponding to the rule of optics the smaller the light source the higher the resolution could a sharp X-ray picture be produced.

It succeeded considerably to increase the resolution power of X-ray apparatus in this manner but only at the price of a very limited electron emission and at the price of a greatly decreased life span of the hot cathode. The limited electron emission leads to the result that in the use of the X-ray apparatus in the medical field longer exposure time is required, thereby increasing the burden on the patient, while in use of the X-ray apparatus for material inspection, the penentration power is limited the inspection requires considerably more time and the possibility of inspecting moving objects is considerably limited. The greatly decreased life span of the hot cathode makes frequent changing necessary, a procedure in which, after changing the cathode, the X-ray tube must be again evacuated before it is ready for use. This is a time consuming procedure which very unfavorably influences the relation of useful time to down time.

Measures taken with respect to the target of the X-ray tube to solve the problem have led neither to avoiding the above mentioned disadvantages with respect to the cathode nor to an appreciable improvement of the intensity of the emitted X-rays, but rather to an early erosion of the target surface. With respect to the target, persons skilled in the art have strictly followed the rule of Heel that the target angle (angle between a perpendicular to the direction of incidence of the electron beam and the target surface) should be between 10° and 40° because intensity of the X-ray emission occurs at a target angle between 30° and 35°. As no improvement with respect to the target appeared possible, efforts to improve the intensity have been directed to the cathode of the X-ray tube but have ended in the above mentioned limitations.

SUMMARY OF INVENTION

It is an object of the invention to increase the intensity of the electron emission from the microfocus of a hot cathode while at the same time considerably increasing its life span, and to increase the intensity of the X-ray emission in an unexpected manner.

The invention is based on the realization that the life span of a hot cathode is higher the greater the cross section of the hot filament and the lower its temperature, at least on the surface, and that the surface of a relatively thick filament can form a microfocus only when an area of the surface is exposed to special physical conditions which do not prevail on other parts of the surface and are adapted to favor the electron emission.

In accordance with the invention, the cathode comprises a hot filament of which the dimensions are large with respect to the dimensions of the electron emitting surface.

In this manner it is possible, in spite of the use of a very stable hot filament which, by reason of its large cross section and its surface temperature, has a long life, to create a microfocus which is characterized by an especially high intensity of electron emission. Through the arrangement of the electron emission area in two fields, one an electrical field and one a temperature field on the surface of the hot filament, of which the peak values fall on one of the same place, it is possible to create on the hot filament a focus of intensive electron emission from a very small area although the diameter of the hot filament is much greater.

To create this minute spot of higher temperature it is not necessary to use external radiation, for example light rays or infrared rays, or a laser, the spot of higher temperature is created in a far simpler but effective way in that the hot cathode is (partially) surrounded by a heat absorbing body so that heat rays are absorbed from all portions of the surface of the hot filament more than from the site of the electron emitting surface. This purpose is served by the grid as a simple, presently available, construction element provided only that it is dimensioned in a particular manner.

Through this radiation absorbtion but also with other means of cooling, it is possible to obtain differential strong cooling of the hot filament so that the highest temperature on the surface of the hot filament prevails at the site of the electron emitting surface.

This method makes it possible to realize a fine focus X-ray tube which is characterized in that the hot cathode comprises a filament of which the dimensions are great with respect to the dimensions of the electron emitting surface and that means is provided for attaining the higher surface temperature at that place where the electrical field between the anode and the cathode has its highest value.

It is advantageous when the means for attaining a surface area of higher temperature comprises an effective radiation absorbing device which partially surrounds the hot cathode. With such device, it is possible to obtain an enormous increase in the intensity of the electron emission at minimum expense.

This radiation absorbing device can be the grid which in any case is present in the X-ray tube provided only that it is proportioned in a particular manner to serve the purpose of radiation absorbtion. Such a fine focus X-ray tube is characterized in that the grid is formed as a thick walled, hollow circular cylinder partially surrounding the hot cathode and having at its outer end an inwardly extending annular projection of which the outer surface is funnel-shaped with an included angle between about 100° to 140° and that the hot cathode is arranged with the portion farthest from the inside of the grid located on the axis of the grid and approximately in a plane defined by the inner edge of the funnel-shaped part of the end surface of the grid.

In such X-ray tube, the hot cathode can be formed as a U-shaped or V-shaped bent wire. In cooperation with the grid serving as a cooling device, the tip of the bend of the hot wire forms a minute spot which is least affected by the cooling action and which, as it lies at the same time in the site of the highest field of strength, constitutes a site of especially intensive electron emission. Thus with an electrode which is in no way pointed and of a form and size heretofore considered unsuitable, there is unexpectedly attained a microfocus of which the electron emission efficiency greatly exceeds that of known point-form electrodes. The cooling action directly on the outer surface part of the glow cathode is responsible for the greatly increased life span of the glow cathode.

A further increase in the intensity of the X-rays which far exceeds that which could be expected from the increase in electron emission is attained by giving the target a spherically curved surface and selecting a target angle of between 0° and 10°. This increase in X-ray emission is unexpected because persons skilled in the art use a different target angle according to the theory of Heel. Through the interaction of the measures in accordance with the invention with respect to the cathode and the measures in accordance with the invention with respect to the anode, there is attained an increase of intensity more than an order of magnitude without special expense and without loss of life span.

The best results are obtained with a fine focus X-ray tube which is characterized in that the glow cathode comprises a wire the dimensions of which are great in relation to the dimensions of the electron emitting surface, such wire being bent essentially in U-form, that the grid is formed as a thick walled body of rotation surrounding the glow cathode in the form of a hollow cylinder with an inwardly directed annular projection at the outer end, of which the outer surface is funnel-shaped with an included angle of about 100° to 140°, such grid serving on the one hand for formation of the electric field and on the otherhand as a radiation absorbing body which on its outwardly directed side discharges radiation, and that the glow cathode in the portion farthest from the inner perimeter of the grid lies on the axis of the grid and approximately in a plane defined by the inner edge of the funnel-shaped outer surface of the grid. With this fine focus X-ray tube the target has a spherically curved surface and the target angle has a value between approximately 0° and 10°.

BRIEF DESCRIPTION OF DRAWINGS

The nature, object and advantages of the invention will be more fully understood from the following description of embodiments shown by way of example in the accompanying drawings in which.

DESCRIPTION OF PREFERRED EMBODIMENTS

Figure 2:
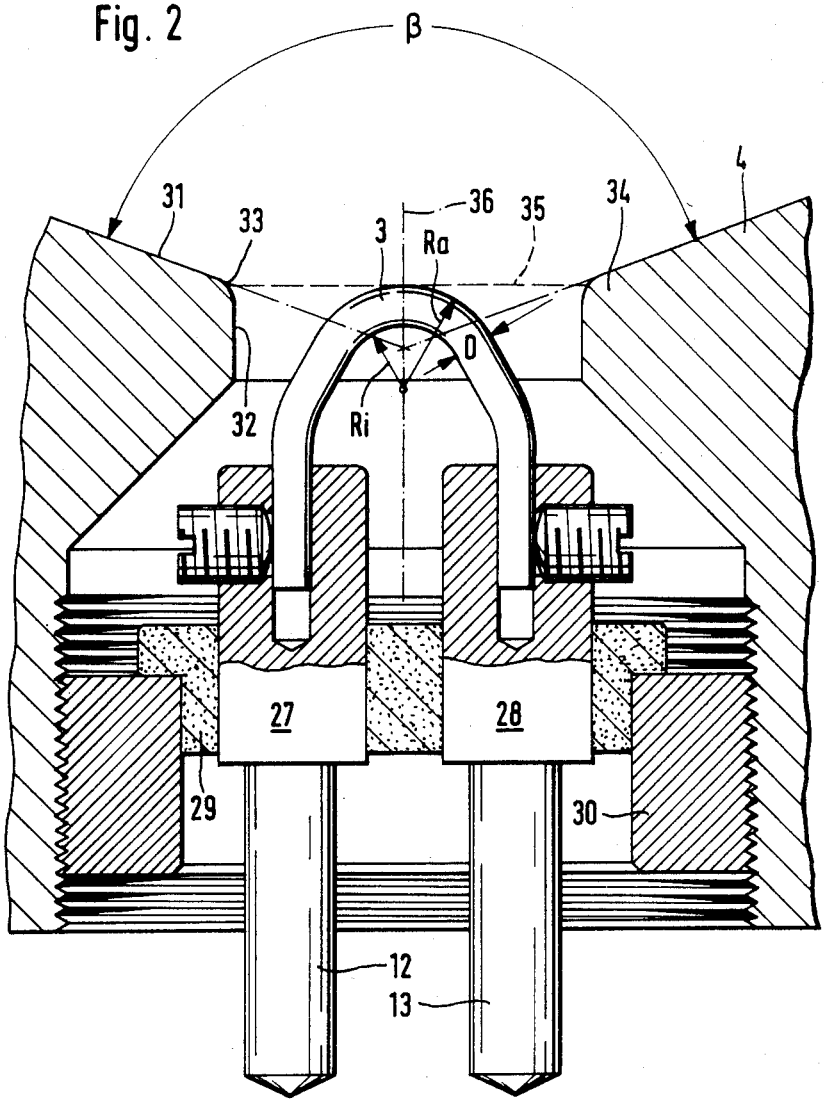
FIG. 2 is an enlarged axial section in the region of the cathode and the grid.

As illustrated by way of example in FIG. 2, an X-ray tube in accordance with the present invention comprises a housing made up of two cylindrical parts 1 and 2 which are joined with a hermetic seal, for example provided by an O-ring. The part 1 houses the cathode consisting of a hot filament 3 which serves as an emitter for an electron beam 11, terminal contacts 12,13 for the hot filament 3, a socket 15 and a grid 4 which is likewise carried by the socket 15 and which by means of a terminal contact 14 is connected with a voltage source (not shown).

The part 2 serving as an anode, houses a focusing coil 5 provided with an air gap 26 and deflection coils 6 and is provided with a target head 7 in which there is a target 8 (the anticathode) and a screen 16. An opening for the outlet of the X-rays 10 produced on the target 8 is closed by an exit window 9. The target head is cooled by a cooling fluid supplied by inlet and discharge tubes 17.

The housing part 1 is provided with a vacuum connection 18. The electrical connections for the focusing coil 5 and the deflection coils 6 are designated by the reference numerals 19, 20, 21, 22 and 23. Between the two housing parts 1 and 2 of the X-ray tube there is a partition (anode) 24 which is formed integrally with part 1 and is provided with a central opening 25 for passage of the electron beam 11.

In FIG. 2, the construction of the cathode and grid are shown on an enlarged scale. The cathode 3 is shown as comprising a hot filament (emitter) bent in U-shape and secured by clamp devices 27 and 28 to the terminal contacts 12,13 through which current is supplied to the filament 3 to bring the filament to incandescence. The two clamping devices 27,28 are mounted in an insulating holder 29, which by means of an externally threaded insulating ring 30 also carries the internally threaded grid 4. The grid 4 is formed as a thick walled hollow cylinder having at its outer end an inwardly extending annular projection 34 of which the outer end face 31 is funnel-shaped with an included angle between about 100° and 140° and preferably about 120°. This funnel-shaped surface 31 merges into the cylindrical inner peripheral surface 22 through a rounded corner 33. The inner end face of the annular projection 34 angles into the internally threaded rear portion of the grid. In the region of the rounded corner 33, there is a plane 35 in which that portion of the surface of the hot wire 3 is located which emits electrons.

Through the special geometric form of the grid there is, on the one hand, produced an electric field which has its peak value on the central axis 36 where the axis 36 intersects the surface of the hot wire 3 which is directed to the target 8.

On the other hand, through the special geometric form of the grid 4, more radiation is dissipated to the grid from all surface parts of the hot filament 3 than from that site of the hot filament where the geometric axis 36 intersects that surface of the hot wire which is directed toward the target 8. As the diameter D of the hot wire there is selected a value of more than 0.17 mm while the inside radius Ri of the bend of the hot wire is greater than 0.1D. These dimensions are considerably greater than the dimensions heretofore used for fine focus X-ray tubes. The inner radius Ri and the outer radius Ra can also have considerably greater values. In many cases, it is advantageous to provide the massive ring-form grid 4, formed as a block, with an additional skirt 37 in order to increase the area of dissipation of the heat absorbed from the cathode. This skirt 37 is advantageously formed integrally with the grid 4 and represents in effect a massive hollow cylinder.

Figure 1:
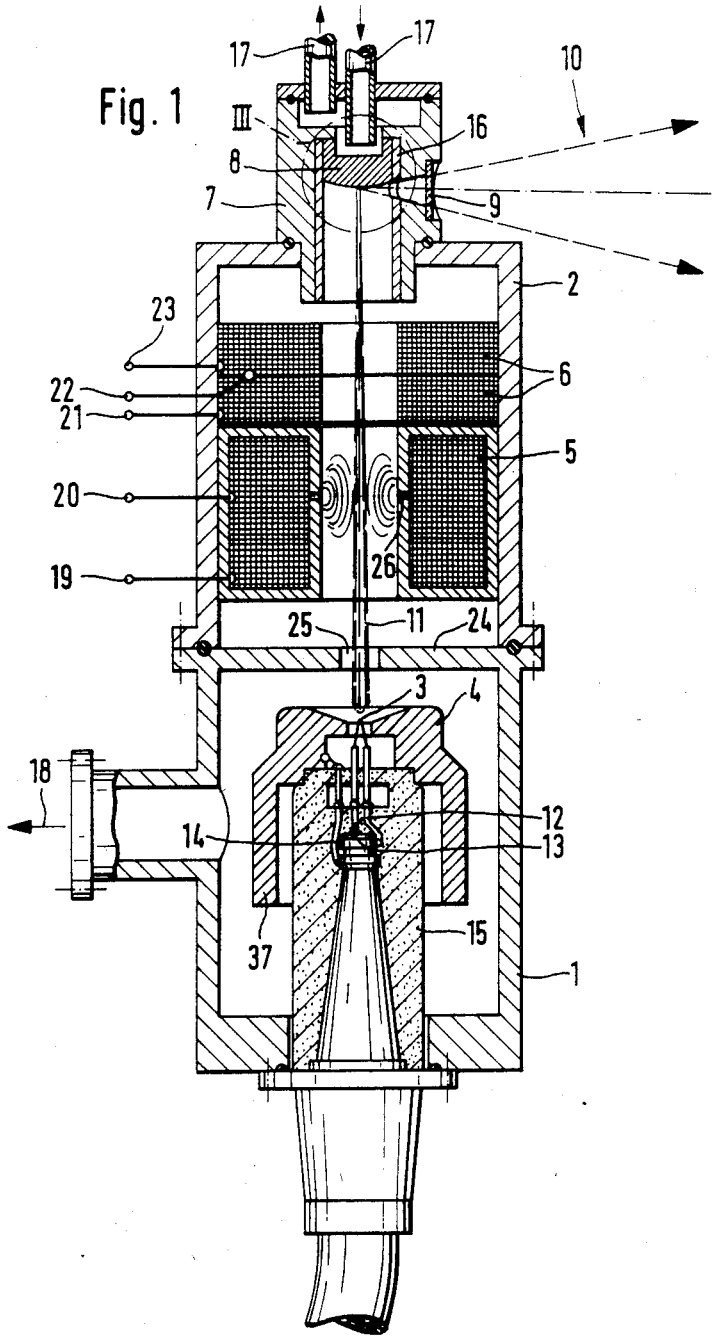
FIG. 1 is an axial section through a fine focus X-ray tube in accordance with the present invention.
Figure 5:
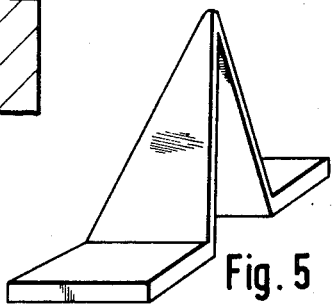
FIG. 5 is a schematic perspective view showing another form of the glow cathode.
Figure 6:
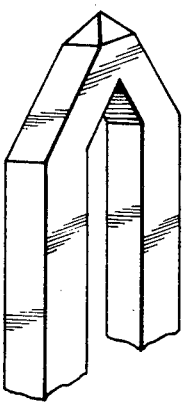
FIG. 6 is a schematic perspective view showing still another form of the glow cathode.

Instead of the hot wire 3 shown in FIGS. 1 and 2 other forms can be used for the emitter in the form shown in FIG. 5 or in FIG. 6. In FIG. 5, the cathode is in the form of a flat strip bent to provide a pyramid-like projection. In FIG. 6 the cathode is formed of a bar of rectangular cross section bent in V-form and provided with a pyramid-shaped tip. The massive emitters shown by way of example in FIGS. 5 and 6 are likewise heated to incandescence through the flow of electric current through them.

Figure 3:
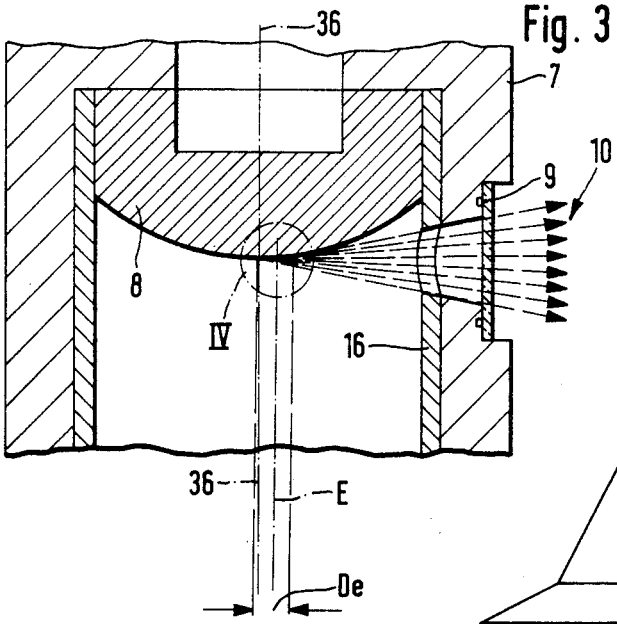
FIG. 3 is an enlarged axial section of the X-ray tube in the region of the target.

FIG. 3 shows on a enlarged scale the detail III of FIG. 1 namely a part of the target head 7 and the target 8 in cross section. The target 8 is formed as a massive block which has a cylindrical or spherical outer face on which the electron beam 11 impinges. The inside of the target head 7 is provided with a lining 16 of lead. Moreover, the target head 7 has a side opening closed by a window 9 through which the X-rays 10 are emitted.

Figure 4:
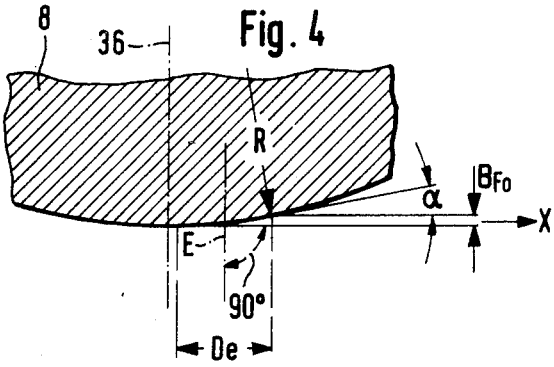
FIG. 4 is a further enlarged section of a portion of the targer.

FIG. 4 shows on a still larger scale detail IV of FIG. 3, namely a portion of the target 8 on which the electron beam 11 impinges. The electron beam 11 has a diameter De and its axis E runs parallel to the central axis 36 of the X-ray tube. The point of intersection of the electron beam axis E with the target and the radius of curvature R of the target are so selected as to provide a target angle $\alpha$ of between 0° and 10°. The target angle is the angle between a tangent to the target surface in the area of impingment of the electron beam and a line perpendicular to the beam axis E. As a very thin electron beam falls on the target 8 by reason of the measures taken with respect to the cathode in accordance with the present invention, the optical focal spot on the target has a very limited width BFo. By selection of a target angle having a maximum value of 10° there is attained a very high intensity of the X-rays the cause of which cannot yet scientifically be explained. It is assumed that there is here a relationship similar to that of total reflection in optics.

The glow cathode need not necessarily be heated by the flow of electric current through the wire. It can for example be heat indirectly, for example by induction. Also in this case, it is important for the dimensions of the glow cathode, which can for example be in the form of a needle or a nail, to be large in relation to the dimensions of the electron emitting surface and for the glow cathode to have a spot having a surface temperature higher than that of other surface portions of the cathode such spot being where the electric field between the anode and the cathode has its highest value. There are also other possibilities. There is also the possibility of heating the cathode directly through the flow of electric current and also additionally heat it indirectly.

What I claim is:

1. A fine-focus X-ray tube comprising an evacuated cylinder housing a heated cathode for emitting an electron beam, a grid surrounding said cathode, an anode comprising a partition having an aperture through which said electron beam passes, means for condensing and focusing said electron beam and a target on which said beam is projected to produce X-rays, said cathode comprising a bent filament the dimensions of which are large in relation to its electron emitting surface area, and said grid being in the form of a thick-walled hollow metal cylinder surrounding said cathode and having an outer face facing said target, the outermost part of said cathode comprising said electron emitting surface area being approximately at the level of said outer face of the grid, the small electron emitting surface area of said cathode being heated to a temperature substantially higher than that of the remaining surface of said cathode by passing electric current through said filament to heat said filament while the surface areas of said cathode other than said small electron emitting surface area are cooled by heat absorbing properties of surrounding portions of said grid which are nearer to said other surface areas of said cathode than to said small electron emitting surface area.

2. A fine-focus X-ray tube according to claim 1, in which said grid has a rearwardly extending skirt portion increasing its heat dissipating capacity.

3. A fine-focus X-ray tube according to claim 1, in which the diameter of said filament comprising said cathode is not less than 0.17 mm.

4. A fine focus X-ray tube comprising an evacuated cylinder housing a heated cathode for emitting an electron beam, a grid surrounding said cathode, an anode comprising a partition having an aperture through which said electronic beam passes, means for condensing and focusing said electron beam and a target on which said electron beam is projected to produce X-rays, said grid being in the form of a hollow circular cylinder surrounding said cathode and having at an outer end an annular inward projection with a funnel-shaped outer end surface having an included angle of between about 100° to 140°, and said cathode comprising a bent filament the dimensions of which are large in relation to its electron emitting surface, the outermost part of said cathode being approximately in the plane of the inner edge of said funnel-shaped outer end surface of said grid, whereby to produce an increased surface temperature in a small area of the surface of said filament on which the electric field between the cathode and the anode reaches its highest value.

5. A fine-focus X-ray tube according to claim 4, in which the grid has a rearwardly extending skirt portion increasing its heat dissipating capacity.

6. A fine-focus X-ray tube comprising an evacuated cylinder housing a heated cathode for emitting an electron beam, a grid surrounding said cathode, an anode comprising a partition having an aperture through which said electron beam passes, electromagnetic means for condensing and focusing said electron beam and a target on which said electron beam is projected to produce X-rays, said cathode comprising a filament the dimensions of which are large in relation to its electron emitting surface, and means for producing an increased surface temperature in a small area of the surface of said filament on which the electric field between the cathode and the anode reaches its highest value, said target having a spherically curved surface and the target angle has a value between 0° and 10°.

7. Method of forming a microfocus of the electron emission of an X-ray tube glow cathode having dimensions large in relation to the dimensions of its electron emitting surface, comprising the steps of heating a small electron emitting surface area of said cathode to a temperature substantially higher than that of the remaining surface of said cathode and applying to said cathode an electric field that reaches its peak value at said small electron emitting surface area of higher temperature, said small electron emitting surface area of said cathode being heated to a higher temperature than the remaining surface by passing electric current through said filament to heat said filament and cooling surface areas of said cathode other than said small electron emitting surface area, surface areas of said cathode other than said small electron emitting surface area being cooled by surrounding said cathode with a heat-absorbing body which is nearer to said other surface areas of said cathode than to said small electron emitting surface area.

* * * * *